US006224076B1

(12) United States Patent
Kent

(10) Patent No.: US 6,224,076 B1
(45) Date of Patent: May 1, 2001

(54) PNEUMATIC COMPRESSION STRUT SKATEBOARD TRUCK

(75) Inventor: Tracy Scott Kent, P.O. Box 60634, San Diego, CA (US) 92166

(73) Assignee: Tracy Scott Kent, San Diego, CA (US)

( * ) Notice: Subject to any disclaimer, the term of this patent is extended or adjusted under 35 U.S.C. 154(b) by 0 days.

(21) Appl. No.: 09/528,135

(22) Filed: Mar. 16, 2000

(51) Int. Cl.[7] ..... A63C 17/02
(52) U.S. Cl. ..... 280/87.042; 280/11.28
(58) Field of Search ..... 280/87.041, 87.042, 280/11.27, 11.28, 11.19

(56) References Cited

U.S. PATENT DOCUMENTS 5,114,166 * 5/1992 McCosker ..... 280/87.042
5,263,725 * 11/1993 Gesmer et al. ..... 280/87.042
5,868,408 * 2/1999 Miller ..... 280/87.042
5,997,018 * 12/1999 Lee ..... 280/87.042

* cited by examiner

*Primary Examiner*—Richard M. Camby

(57) ABSTRACT

The Pneumatic Compression Strut Skateboard Truck is intended for use in street and off-road skateboarding. This new design is completely different than any conventional skateboard truck. This truck utilizes a pneumatic compression strut suspension system, which is of the same type and kind used in automobiles and other mechanical devises employing shock absorbing technology. The compression struts resist pressure in the direction of their length, thereby decreasing or eliminating shock forces associated with street and off-road skateboarding. By reducing or eliminating these extreme forces, the skateboarder has more maneuverability and control. Further, it reduces or eliminates the shock forces that would normally be transferred to the skateboarder. This will contribute to the decrease in stress and fatigue of the skateboarder's extremities and therefore increase endurance.

18 Claims, 4 Drawing Sheets

PNEUMATIC COMPRESSION STRUT SKATEBOARD TRUCK

CROSS-REFERENCE TO RELATED APPLICATIONS

NA

STATEMENT REGARDING FEDERALLY SPONSORED RESEARCH OR DEVELOPMENT

NA

REFERENCE TO A MICROFICHE APPENDIX

NA

BACKGROUND OF THE INVENTION

NA

BRIEF SUMMARY OF THE INVENTION

The claimed invention is a skateboard truck which is used for skateboarding in a street or off-road environment. The skateboard truck shown and described differs from conventional skateboard trucks by embodying a suspension system.

This suspension system employs the use of pneumatic compression struts. These pneumatic compression struts are of the same type and kind used in automobiles or other mechanical devises utilizing shock absorbing technology. This suspension system with the extensive use of pneumatic compression struts will greatly reduce or eliminate the extreme shock loads associated with street and off-road skateboarding. This allows for more control and maneuverability in street and off-road conditions, as well as, absorbing and reducing most of the associated shock forces that would otherwise be transferred to the skateboarder.

DETAILED DESCRIPTION OF THE INVENTION

Figure 1:
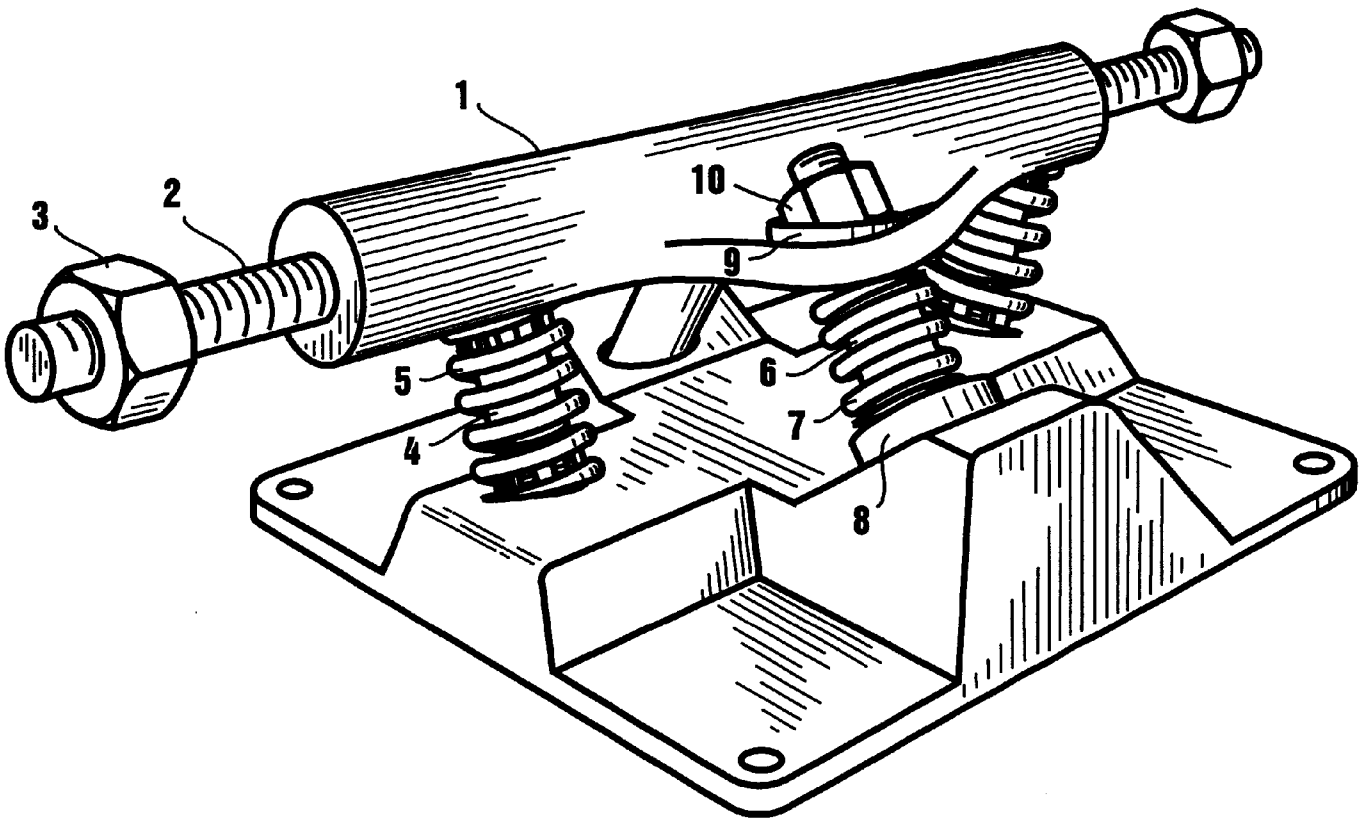
FIG. 1 is a perspective view of the Pneumatic Compression Strut Skateboard Truck showing my new design and structure thereof.
Figure 2:
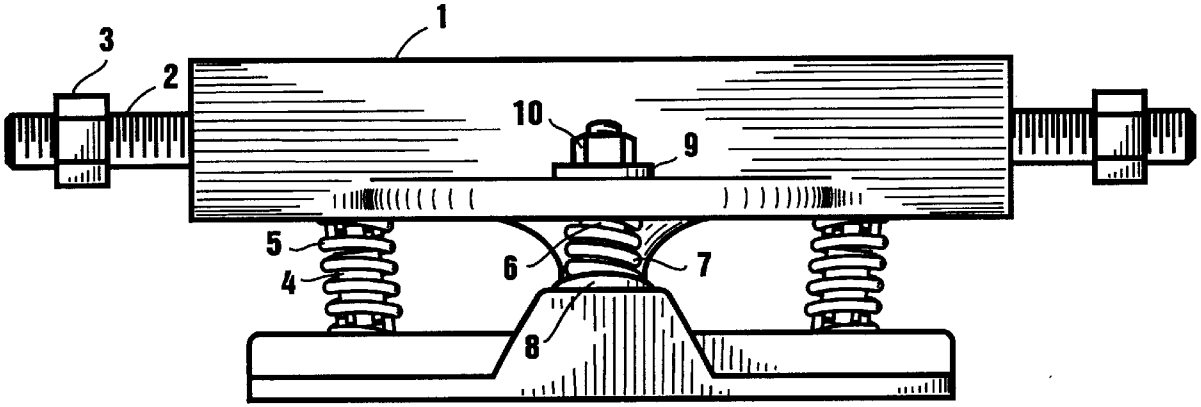
FIG. 2 is a right side view showing the compression strut with compression spring mounted between the truck axle and truck base. The left side is identical thereof.
Figure 3:
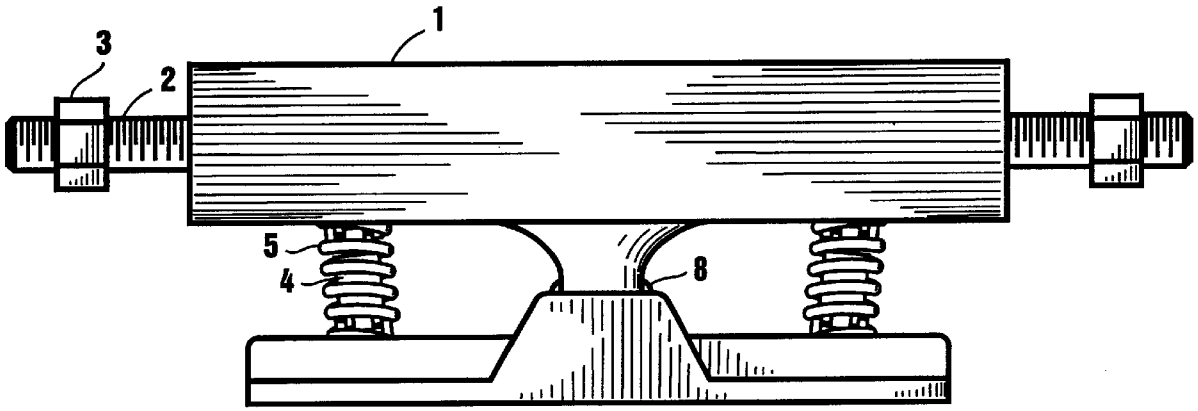
FIG. 3 is a front view of the skateboard truck thereof.
Figure 5:
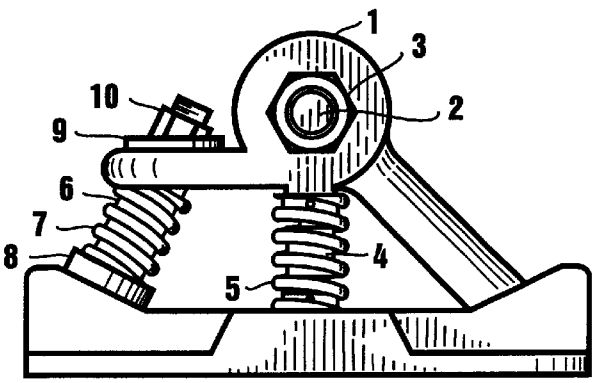
Figure 4:
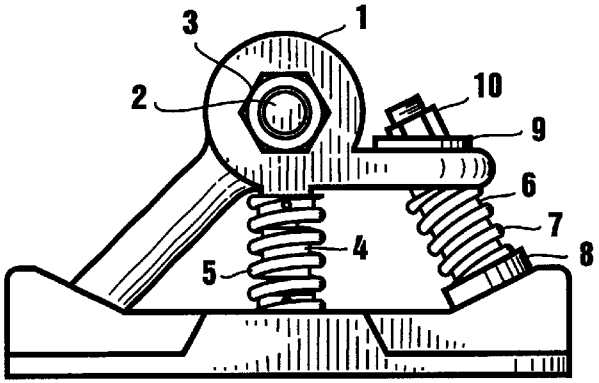
FIG. 4 is a rear view of the skateboard truck. This view depicts both the compression strut assemblies and their attachments to the truck axle and truck base, as well as, the compression assembly utilizing a compression spring and heavy rubber bushings around the truck kingpin.
Figure 6:
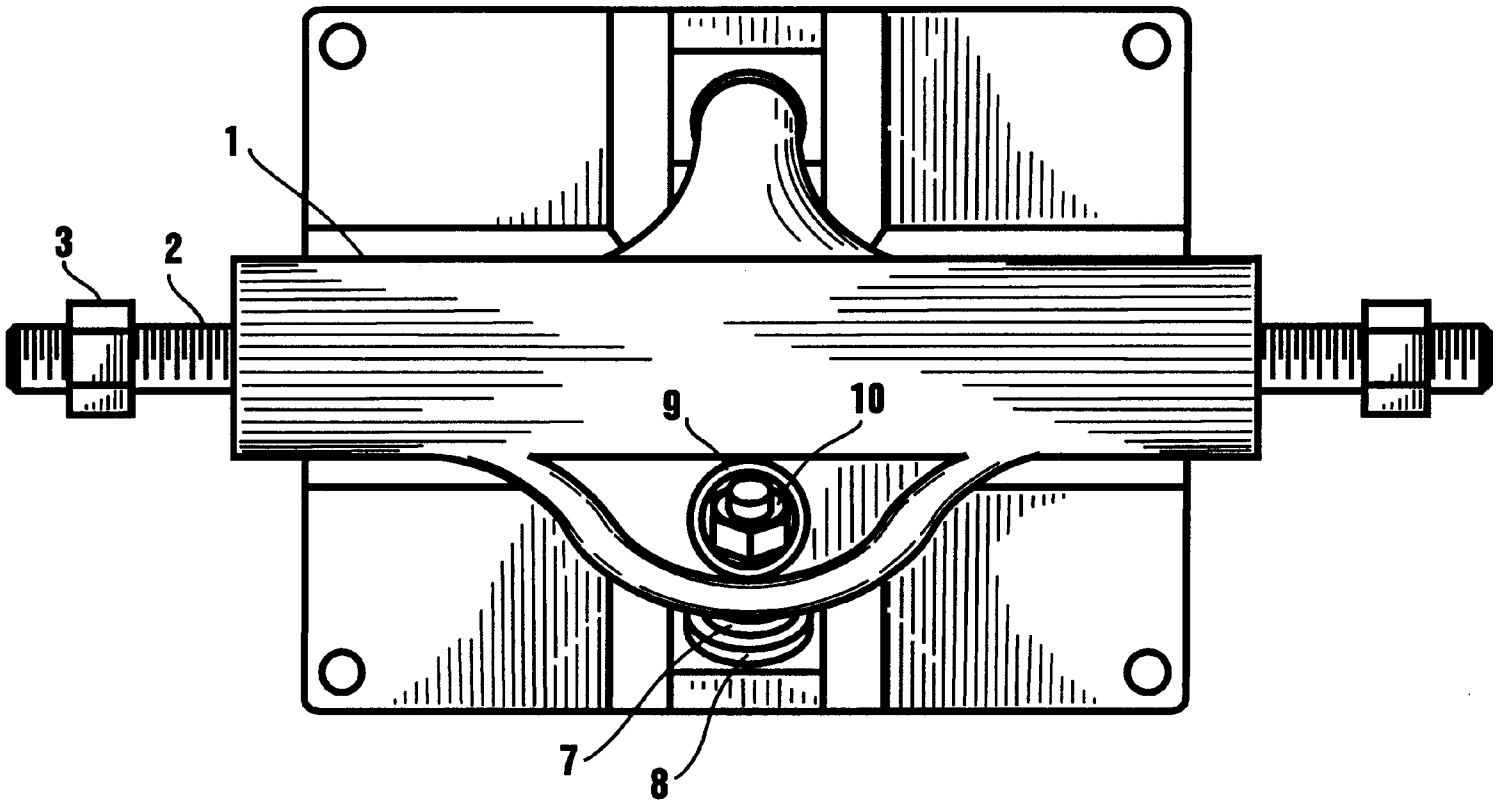

The following is a description of the Pneumatic Compression Strut Skateboard Truck and its fabrication processes. The skateboard truck is intended for use on skateboards in a street or off-road environment. This truck differs from other conventional skateboard trucks by utilizing a suspension system using pneumatic compression struts. These struts greatly absorb and reduce the tremendous shock forces associated with street or off-road skateboarding. This allows for greater control and maneuverability of the skateboard, and absorbs or eliminates most of the jolt that would otherwise be transferred to the skateboarder.

The truck axle 1 will be dye cast of various suitable metallurgical alloys. All casting marks shall be burnished to a smooth and consistent finish. Axle studs 2 shall be tap threaded to accomdate the wheel hex lug nuts 3. The pneumatic compression strut mounts will be press drilled through both sides. One side of the mount shall be tap threaded to facilitate attachment of the pneumatic compression strut 4 to the compression strut mount utilizing a threaded clevis pin and secured with seizing wire.

The truck base will be either dye cast or hydraulically stamped formed. The material used will be determined by which method the base is fabricated. Regardless of fabrication method, the finish shall be burnished to be smooth and consistent. The pneumatic compression strut mounts shall be press drilled through both sides. One side of the mount shall be tap threaded to facilitate attachment of the compression strut to the compression strut mount utilizing a threaded clevis pin and secured with seizing wire.

One through hole shall be press drilled in th e bottom of the base to facilitate attachment of the truck axle to the truck base by means of the kingpin. Through holes will be press drilled one in each corner of the base to facilitate attachment of the truck assembly to the skateboard deck.

The pneumatic compression struts are the same type and kind as those used in automobiles or other mechanical devises utilizing shock absorbing technology. These struts are gas filled and are designed to resist pressure in the direction of their length, thereby decreasing the shock forces due to compression of the gas by the strut piston.

The compression springs 5 will be of high grade steel or other suitable materials. They will be produced by typical spring fabrication methods.

The kingpin 6 shall be machined from high grade steel or other suitable materials, using various milling techniques. Both ends of the kingpin shall be tap threaded to the appropriate size to accomdate th e securing hex nuts. The tap threaded kingpin shall then be inserted in the through hole at the bottom of the truck base and secured with a hex nut flush with the bottom of the truck base. The kingpin will then be fitted with a neoprene rubber bushing 8 followed by a compression spring 7. The yolk of the truck axle will be positioned over the kingpin followed by another neoprene rubber bushing 9 and secured with a hex nut 10. The truck axle is now joined to the truck base. Subsequently, the compression springs are to be placed over the compression struts before mounting. The through hole ends of the compression struts are then positioned into the compression strut mounts. The threaded clevis pins are then inserted through one side of the compression mount and through the attachment through hole of the compression strut. Then they are screwed into the thread through hole of the compression mount and secured with seizing wire.

The Pneumatic Compression Strut Skateboard Truck is now assembled and ready for mounting to the skateboard deck.

What is claimed is:

1. A pneumatic compression strut skateboard truck comprising a) a crossbar including a central body with anterior U shaped through-holed aperture neck, axles including threaded end portions which are attached to the terminal ends of the central body, extending outward for means of attaching wheels, extending outwardly posterior and perpendicular from the center of central body is a stabilizing post to steady the crossbar to a baseplate b) the baseplate including two raised hemispherical U shaped through-hole mounts, central to the coiled constant rate compression spring retention stops, equidistant on opposite sides of the baseplate for attaching pneumatic compression struts to the baseplate c) coiled springs including three vertically coiled constant rate compression springs having definite, open and opposite ends d) said pneumatic compression struts including gas filled cylinder, piston, piston rod arm with piston rod arm mounts and base arm with base arm mounts for attaching one end of the pneumatic compression strut to the crossbar and the opposite end to the baseplate.

2. The skateboard truck of claim 1, in which on lower surface of the crossbar central body are dye cast hemispherical raised U shaped through-holed mounts which are central to the coiled constant rate compression spring stops on opposite ends of the central body for attaching the pneumatic compression struts to the crossbar.

3. The skateboard truck of claim 2, where the U shaped through-holed aperture neck in the center of the central body will accept a pivot rod, coiled constant rate compression spring and rubber bushing for securing the crossbar to the baseplate where the central body will rotate upon the pivot rod.

4. The skateboard truck of claim 3, in which centrally located on the anterior portion of the baseplate will be a raised threaded engagement socket where the pivot rod will be rotated and secured to the baseplate by means of the raised threaded engagement socket.

5. The skateboard truck of claim 4, the pivot rod will extend from the raised threaded engagement socket up through the anterior U shaped through-holed aperture neck of the crossbar and rubber bushing to be secured with a hex nut forming a pivotal junction.

6. The skateboard truck of claim 5, the coiled constant rate compression spring will extend from the raised threaded engagement socket and securing into the recessed compression spring stop on the lower surface of the U shaped through-holed aperture neck of the crossbar.

7. The skateboard truck of claim 6, in which centrally located on the posterior portion of the baseplate will be a raised engagement socket where the perpendicular stabilizing post of the crossbar central body will engage the baseplate, surrounding the raised engagement socket will be a rubber grommet to absorb all shock forces associated with stabilizing post movement.

8. The skateboard truck of claim 7, in which four through-holed apertures, one located in each corner of the baseplate will be utilized for attaching baseplate to an appropriate platform.

9. The skateboard truck of claim 1, in which one coiled constant rate compression spring will be slid over one pneumatic compression strut and its open end will engage the spring retention mounting stop on the baseplate.

10. The skateboard truck of claim 9, in which one coiled constant rate compression spring will be slid over the opposite pneumatic compression strut and its open end will engage the spring retention mounting stop on the baseplate.

11. The skateboard truck of claim 9, where the opposite end of the coiled constant rate compression spring will engage the constant rate compression spring stop on the lower surface of the central body of the crossbar.

12. The skateboard truck of claim 10, where the opposite end of the coiled constant rate compression spring will engage the constant rate compression spring stop on the lower surface of the central body of the crossbar.

13. The skateboard truck of claim 1, where the pneumatic compression struts are cylindrically shaped having longitudinal axis and includes a gas filled cylinder body, piston rod arm where one end extends directly from the raised dye cast hemispherical U shaped through-holed pneumatic compression strut crossbar mounts, through the cylinder end wall where the other end is attached to the pneumatic piston, attached to the opposite cylinder end wall is the base arm which extends directly form the cylinder end wall to the raised dye cast hemispherical U shaped through-holed pneumatic compression strut baseplate mounts.

14. The skateboard truck of claim 11, in which the pneumatic compression struts are mounted bilaterally on the crossbar and base plate.

15. The skateboard truck of claim 1, where the axle studs shall be tap threaded to the appropriate size to accommodate the mounting of most standard wheels.

16. The skateboard truck of claim 1, where the raised hemispherical U shaped dye cast pneumatic compression strut mounts on the crossbar and base plate will be press drilled through both sides to accommodate mounting of the pneumatic compression piston arms and base arms to the crossbar and base plate.

17. The skateboard truck of claim 16, where one side of the raised dye cast hemispherical U shaped mount shall be tap threaded to facilitate attachment of the pneumatic compression strut to the compression strut mount.

18. The skateboard truck of claim 17, these compression strut mounts will then utilize a threaded clevis pin to secure the pneumatic compression strut to the pneumatic compression strut mounts.

* * * * *